US007530181B2

(12) United States Patent
Joynt et al.

(10) Patent No.: US 7,530,181 B2
(45) Date of Patent: May 12, 2009

(54) PROTECTIVE FOOTWEAR

(75) Inventors: Vernon Peregrin Joynt, Waterkloof (ZA); Jacobus Theodorus Van Dyk, Brunia Oord (ZA)

(73) Assignee: CSIR, Pretoria (ZA)

( * ) Notice: Subject to any disclaimer, the term of this patent is extended or adjusted under 35 U.S.C. 154(b) by 637 days.

(21) Appl. No.: 10/516,403

(22) PCT Filed: May 27, 2003

(86) PCT No.: PCT/IB03/02032

§ 371 (c)(1),
(2), (4) Date: Jul. 29, 2005

(87) PCT Pub. No.: WO03/101234

PCT Pub. Date: Dec. 11, 2003

(65) Prior Publication Data

US 2006/0000117 A1 Jan. 5, 2006

(30) Foreign Application Priority Data

May 31, 2002 (ZA) ..... 02/4368
Jun. 5, 2002 (ZA) ..... 02/4480
Jan. 24, 2003 (ZA) ..... 03/0684

(51) Int. Cl.
*A43B 23/00* (2006.01)
*A43B 13/12* (2006.01)

(52) U.S. Cl. ..... 36/25 R; 36/107; 36/30 R; 36/72 R

(58) Field of Classification Search ..... 36/25 R, 36/30 R, 72 R, 73, 107, 109, 85, 87, 1.5, 36/2 R, 113, 116
See application file for complete search history.

(56) References Cited

U.S. PATENT DOCUMENTS 3,061,951 A * 11/1962 Barron ..... 36/7.5
3,243,898 A 4/1966 Lewis et al.
3,318,024 A * 5/1967 Fujinaka et al. ..... 36/85
3,516,181 A * 6/1970 Jordan ..... 36/7.5
3,636,895 A * 1/1972 Kelsey ..... 109/78
4,611,411 A * 9/1986 Ringler et al. ..... 36/7.5
6,006,646 A * 12/1999 Makris et al. ..... 89/36.05
6,505,421 B1 * 1/2003 Vaz ..... 36/30 R
6,725,572 B1 * 4/2004 Krstic ..... 36/25 R
6,751,892 B2 * 6/2004 Chavet et al. ..... 36/113

FOREIGN PATENT DOCUMENTS

GB 2191384 12/1987
WO WO 01/18479 3/2001

* cited by examiner

*Primary Examiner*—Jila M Mohandesi

(57) ABSTRACT

An article of protective footwear in the form of a boot (10) protects a foot (12) of a user against effects of a landmine explosion. A composite sole volume (16) between an outer sole (18) and an inner sole (20) incorporates shock wave guide elements (28) of a material having a high acoustic speed, in the form of glass strips which extend spatially from the outer sole (18) obliquely laterally outwardly to a side of the sole volume. The strips (28) are surrounded by liquid. Above the strips (28) and below the inner sole (20), there is provided a barrier of material having a low acoustic speed, e.g. vermiculite. Surrounding the foot (12), opposed to the sole of the foot, there is provided a fluid having a high acoustic speed, e.g. glycerin to ensure effective transfer of any shock wave component entering the foot, away from the foot.

27 Claims, 2 Drawing Sheets

PROTECTIVE FOOTWEAR

Figure 1:
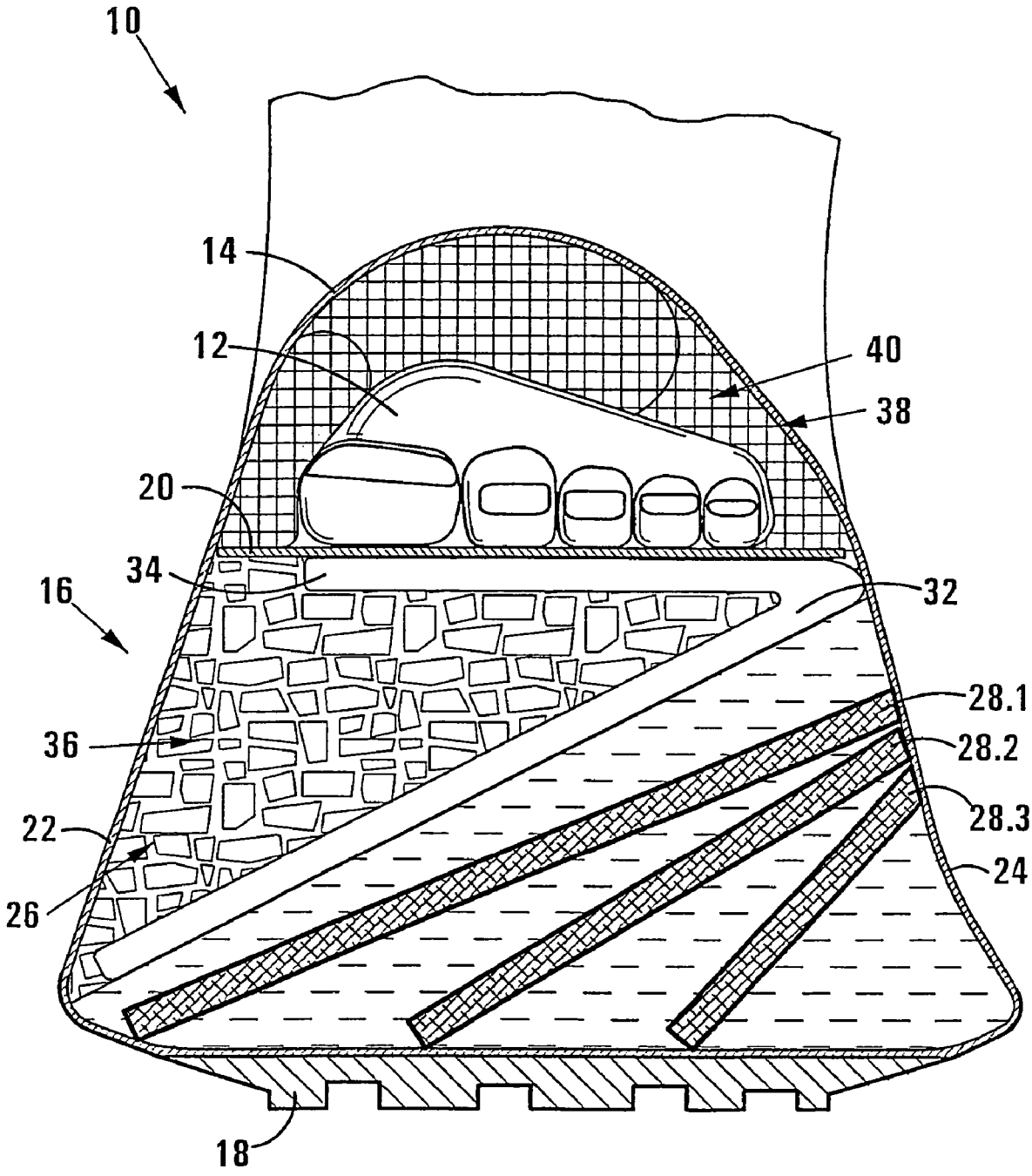

This invention relates to protective footwear. It relates more specifically to an article of footwear for protecting a wearer against the effects of a landmine explosion, especially an anti-personnel landmine explosion.

U.S. Pat. No. 3,243,898 discloses an underfoot attachment device having a V-shaped deflector or wedge of substantially un-deformable metal having an inverted apex extending centrally along a length of a footprint of a user. The deflector is contained along its bottom and outsides in a block of balsa wood, is internally filled with an acoustic filler, and is contained in a plastic hull. The deflector is intended to deflect the force of an exploding mine away from a foot and limb of a user.

WO 01/18479A1 discloses an article of footwear including a lower matrix underneath a foot of a wearer, an outer hard shell around the foot, and an upper protective surround around a lower portion of a leg of the wearer. The matrix incorporates a substantially non-deformable deflector in the form of a metal sheet oriented obliquely upwardly to deflect an up-welling result of an exploding landmine obliquely laterally. Underneath the deflector is provided a layer of "DETSHEET", a detonation material adapted to detonate when subjected to, shock and pressure waves of an exploding landmine, to dissipate the first shock and pressure waves and, to some extent, subsequent effects of the explosion. Layers of a frangible material are provided above the deflector and below the "DETSHEET". Laminated sheets of Kevlar impregnated fabric of wedge shape, and a plug of energy dissipating material, followed by an open honeycomb structure are provided in superimposed arrangement between the deflector and an inner sole of the article of footwear. A sock of soft foam material surrounds the foot and lower leg and acts as a soft lining underneath the hard outer shell and protective surround.

Although the Applicant does not wish to be bound by theory, it is nevertheless believed that a theoretical explanation of some concepts relating to the effects of a landmine explosion will assist the reader in appreciating the inventive contribution which the inventors have made and the principles underlining this invention. Thus, some concepts of relevance are briefly explained.

The Applicant has appreciated that shockwaves play an important role in the field of the invention and, in contra distinction to other inventors in the field, has focused efforts in understanding and dealing with the shock wave effect of a landmine explosion.

Shock waves are in certain respect equivalent to acoustic waves, for example, progression of a shock wave through a material is not associated with transfer of mass or particles, it progresses as a wave. Furthermore, the speed of progression through a material is dependent on physical properties of the material, i.e. in the case of solid material, speed is proportional to the density and inversely proportional to the Young's modulus of the material. Yet further, the Applicant has appreciated the significance that speed of progression through liquids differ, and is generally lower than that through "rigid" solids such as ceramics, metals, and the like, but generally higher than through gasses such as air. Yet further, the role that temperature of a gas plays in respect of acoustic speed is significant—e.g. the acoustic speed through air at 1000° C. is more than twice the acoustic speed through air at normal ambient temperature. Still further, the acoustic speed is surprisingly low through "elastic" materials such as rubber, some synthetic polymeric materials, and the like. Although this kind of information is known, the significance in the field of the invention has not thus far been appreciated or has not been appreciated fully by other experts in the field of the invention.

A further aspect appreciated by the Applicant is that, although only about 40% of energy associated with a landmine explosion is present as shock wave energy, dealing with, or managing, the shock wave energy, surprisingly, has an important influence or effect on the major portion (about 60%) of energy associated with blast effect created by a landmine explosion. This phenomenon is explained below.

In accordance with a first aspect of this invention, there is provided a method of protecting a foot of a human from effects of a landmine explosion underneath said foot, including guiding shock waves caused by the landmine explosion obliquely away from said foot by means of a correspondingly obliquely oriented shock wave guide member embedded in a sole volume of an article of footwear worn by the human.

Guiding the shock waves may, advantageously, be obliquely laterally outwardly.

In this regard, it is to be appreciated that, for purposes of this invention, direction, orientation, and the like must be interpreted in relation to an article of footwear in its normal orientation i.e. the toe end of the article of footwear will be regarded as a "fore-end" or "front-end"; the heel end will correspondingly be regarded as the "rear end"; the sole will be at the under side or bottom of the article of footwear; a side of the article of footwear corresponding to a big toe of the wearer will be regarded as the "inside" and correspondingly the side of the article of footwear associated with the small toe of the wearer will be regarded as the "outside" or "outer side".

Similarly, the terms "upstream" and "downstream" will be used in relation of progression of shock waves, in this specification.

The shock wave guide member may be selected to have a high acoustic speed, higher than 3000 m/sec., preferably in the region of 6000 m/sec.

By way of development, the method may include absorbing heat energy by evaporating liquid contained in the sole volume. The liquid, ideally, will have a high latent heat value and a low boiling point. Water, a mixture containing water, and the like are regarded as suitable. The liquid may be proximate the guide member. It may surround the guide member.

By way of further development, the shock wave guide member may be a composite shock wave guide member comprising a plurality of shock wave guide elements, guiding then being effected by means of the plurality of guide elements. Each shock wave guide element may be in the form of a strip of rigid glass containing material, the strips being oriented transversely to allow bending of the article of footwear along transverse bend lines intermediate adjacent strips.

The Applicant has observed, surprisingly, that the blast effect of a landmine explosion tends to follow the direction of the leader wave which is a shock wave. The Applicant has appreciated the significance that the shock wave leads the blast effect because of the generally higher progression rate of the shock wave than the progression rate of the blast. Again, without wishing to be bound by theory, the Applicant believes that progression of a shock wave, appropriately managed, causes spalling of material, more specifically spalling of an outer side of the composite sole of the article of footwear, in the context of this invention. In the event that such spalling causes a fragment loosened by spalling to be launched, the fragment causes an area or path of low pressure trailing the fragment. Thus, a path of lesser resistance is created by the shock wave. The Applicant was of opinion, and has now confirmed by observation, that such spalling creating the path of lesser resistance influences the blast to follow the shock wave along said path of lesser resistance. Thus, the guide elements may converge to concentrate the guided shock wave to ensure spalling. Furthermore, the shock wave guide member may be of a material selected to be easily pulverizable. It is expected that the shock wave will crack and pulverize the glass strips. It is important that speed of progression of the shock wave is far higher at about 6000 m/sec. than the speed of progression of cracking or pulverizing at roughly 1500 m/sec. Thus, the glass strips are fully effective to guide the shock wave, and are immediately thereafter pulverized to facilitate displacing of the glass dust by means of the blast, thus yet further promoting creation of the path of lesser resistance. Thus, if the shock wave is guided obliquely laterally away from the body of the victim, not only does the victim have the advantage of encountering attenuated shock wave, or of encountering the shock wave to a lesser extent, it also has the advantage of encountering a lesser portion of the following blast. Thus, guiding the shock wave away from the body has the expected primary advantage, but it leads also to the above, surprising, secondary advantage in respect of the following blast.

The Applicant believes that this invention provides, in the first instance, for guiding of shock waves laterally obliquely away from the body, but also provides for deflecting of the following blast laterally obliquely away from the body.

By way of further development, the method may include covering the guide member from above by means of a solid shield arranged in the sole volume above the guide member. The shield may be oriented obliquely in correspondence with orientation of the guide member. The shield may be anchored by means of an integral decumbent flange toward a top of the sole volume. When oriented obliquely, the shield will act as a deflector of shock waves.

The method may include attenuating progression of any stray component of the shock waves in a direction toward said foot in the sole volume of the article of footwear by means of a layer of material having a low acoustic speed, lower than about 200 m/sec., arranged between the shock wave guide member and an inner sole of the article of footwear. The material may be in the form of vermiculite, or a composite material containing vermiculite. The Applicant has, surprisingly, realized that vermiculite has an acoustic speed approaching zero, and that it will be particularly effective in attenuating, even checking, progression of shock waves.

By way of yet further development, the method may include enhancing shock wave progression downstream of the foot by means of a layer of soak-out material in close contact with skin along a foot surface opposite a sole of the foot, the layer of material having an acoustic speed at least equal to acoustic speed of flesh. The acoustic speed of said soak-out material may be higher than the acoustic speed of water.

This feature applies a phenomenon which has not yet received any attention from other inventors. To the best of the Applicant's knowledge, without exception, all attention thus far has been directed at mitigating the effects of a landmine explosion upstream of the body (foot) of the human to be protected, and no attention whatsoever has been paid to an area downstream of a foot of a human. The Applicant has noticed in boots worn by landmine explosion victims that, in many instances, surprisingly, a respective boot was virtually unharmed in the sole area, whereas the upper was shattered. The Applicant has concluded that shock waves act in a manner similar to light waves when they reach an interface between materials of different optical/acoustic density. Contrary to instinct, the Applicant believes that a sound wave moving through a relatively high acoustic speed material and reaching an interface with a material of relatively low acoustic speed reflects or deflects from the interface back into the higher acoustic speed material, at least partially. Without wishing to be bound by theory, the Applicant believes that the reason for this is that the resistance through the relatively high acoustic speed material is generally lower than the resistance through the material of relatively low acoustic speed, and thus the tendency to reflect or deflect. Such reflection or deflection causes interference between approaching sound waves and deflected or reflected sound waves which can give rise to resonance and other effects causing a concentration of energy and resultant spalling of the higher acoustic speed material proximate the interface.

Thus, the Applicant has concluded that, in the foot of a landmine explosion victim, it is generally impossible to shield the foot entirely from shock waves. Thus, shock waves progressing through the foot of the victim, at the upper surface of the foot, encounters a material of lesser acoustic speed, namely air, causing the shock waves to reflect or deflect, thus causing spalling in the foot and also in the upper of the boot. The Applicant believes that this is a possible explanation for the surprisingly large structural damage of the foot and downstream of the foot of a landmine explosion victim.

Thus, accordingly, the Applicant proposes providing a medium or material of higher acoustic speed than the acoustic speed through the foot of the victim to promote transfer of or progression of shock waves through the interface into the downstream medium. The Applicant expects that this will greatly mitigate the destructive effect of shock waves which do find their way into the body (foot) of the victim. The Applicant believes that spalling would take place, but downstream of the material of higher acoustic speed at that material's interface with ambient air and that the resultant spalling would not have an undue effect on the foot of the victim.

The Applicant also realizes that human bone has a higher acoustic speed than human flesh and that shock waves penetrating the victim's foot will have a tendency to progress along the bones of the victim in preference to flesh of the victim. This may result in the shock waves having a tendency to progress upwardly along the bones in the lower leg of the victim. Thus, the Applicant proposes extending the material of relatively high acoustic speed around the lower leg up to a relatively high level, preferably at least somewhat higher than the upper extremity of the boot.

The method may then include containing the layer of soak-out material in association with a sock worn by the human.

In accordance with a second aspect of the invention, there is provided an article of protective footwear for a human having a composite sole including an outer sole along one extremity of the article of footwear, a spaced inner sole for seating a foot of a user, and a sole volume intermediate the outer and the inner soles, the composite sole including in said sole volume a shock wave guide member oriented to guide shock waves caused by a landmine explosion obliquely away from said foot in use.

The shock wave guide member may, preferably, extend from about the outer sole obliquely upwardly to a laterally outward extremity of the composite sole.

The shock wave guide member may be of solid material having an acoustic speed higher than 3000 m/sec., preferably up to about 6000 m/sec or more. Thus, the shock wave guide member may be of, or may contain, glass. Instead, it may be in the form of a ceramic material.

By way of development, the composite sole volume may contain a liquid proximate the shock wave guide member. The liquid may be in the form of a gel, viscous fluid, or the like. The liquid may be or may contain a mixture of water and alcohol, e.g. between about 50% and about 90% water, preferably about 70% water.

By way of further development, the shock wave guide member may be of composite structure comprising a plurality of shock wave guide elements. Each shock wave guide element may be in the form of a strip of rigid glass or rigid glass containing material, the strips being oriented transversely and arranged adjacent one another to allow bending of the article of footwear along transverse bend lines intermediate adjacent strips. Instead, the strips may be of ceramic material.

The composite sole may incorporate a shield covering the shock wave guide member when it will act also as a deflector deflecting shock waves generally laterally outwardly. The shield may be oriented obliquely in correspondence with the shock wave guide member. The shield may be of a robust sheet material, e.g. a synthetic material such as Kevlar, a metal such as a light metal alloy, e.g. titanium, aluminum or magnesium alloy, or the like.

The shield may be integral with an anchor formation for anchoring it in the sole volume. The anchor formation may be generally decumbent below the inner sole.

By way of yet further development, the article of footwear may preferably include, between the shock wave guide member and the inner sole, a layer of blocking material having an acoustic speed lower than about 200 m/sec. The blocking material may be vermiculite, or a composite material containing vermiculite.

By way of still further development, the article of footwear may include a foot-surrounding upper defining a foot cavity above the inner sole, and a layer of soak-out material in fluid form and having an acoustic speed equal to or higher than the acoustic speed of flesh and arranged to be in close contact with skin at a surface of the foot opposite a sole of the foot in use.

The soak-out material may have an acoustic speed higher than that of water. The soak-out material may be or may include glycerin. The soak-out material may be contained in a closed, flexible container such as a pad or sachet.

By way of development, if desired, the soak-out material may be provided in amongst granular or filamentary material having an acoustic speed higher than the acoustic speed of the soak-out material, e.g. a roving of glass fibers. Thus, the sachet or pad may be filled or stuffed with glass fibre roving, and glycerin may displace all air or other gas fully to fill the sachet or pad.

Accordingly, the invention extends to the combination of an article of footwear containing such soak-out material, and a sock, in which the soak-out material is contained in the sock. The sock may be of thin polyurethane material. The sock and the pad, sachet or the like, may be arranged to extend also along a leg of a user, say from an ankle of a user upwardly, advantageously to a level higher than an upper extremity of the article of footwear.

Figure 2:
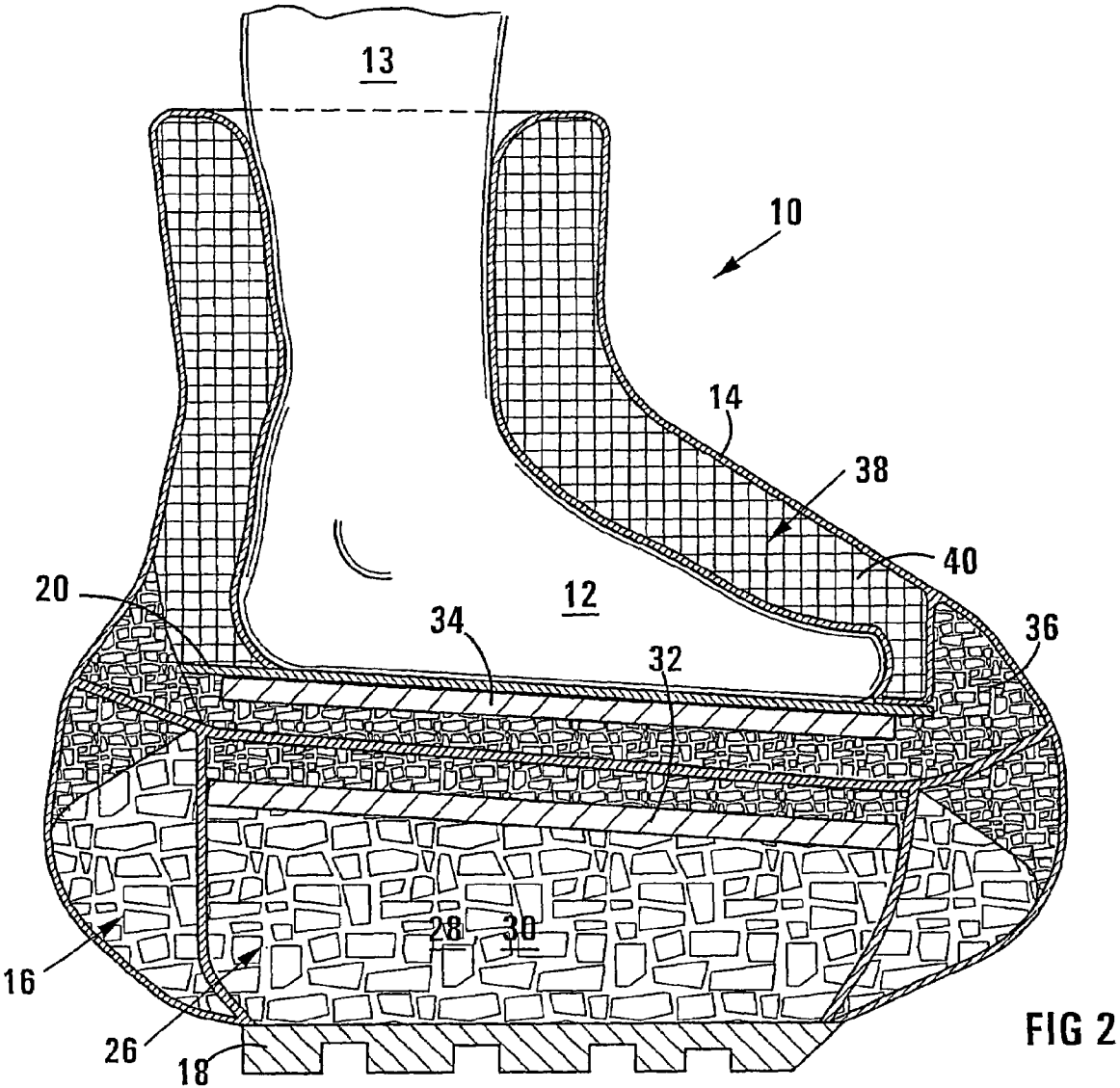

The invention is now described by way of example with reference to the accompanying diagrammatic drawings. In the drawings FIG. 1 shows, in sectional front view, a foot of a human within an article of footwear in the form of a protective boot in accordance with the invention; and FIG. 2 shows the arrangement of FIG. 1 in sectional side view.

With reference to the drawings, an article of footwear in the form of a protective boot in accordance with the invention is generally indicated by reference numeral 10. The boot 10 is used by a human represented in the drawings by his foot 12.

The protective boot 10 has an upper 14 above a composite, thick sole generally indicated by reference numeral 16 and comprising an outer sole 18 at a bottom thereof, an inner sole 20 at the top of the composite sole 16 immediately underneath a foot volume 38 defined by the upper 14. The boot 10 further comprises an inner side 22 associated with a big toe of the user, and an opposed outer side 24. A sole volume 26 is defined between the inner and outer soles and between the inner and outer sides. As mentioned above, the thickness or height of the sole volume 26 is substantial. Furthermore, the composite sole 16 is of generally bell shape tapering from the outer sole toward the inner sole.

In accordance with the first aspect of the invention, a composite shock wave guide member comprising a plurality of shock wave guide elements 28 is provided in a particular position and a particular orientation within the sole volume 26. The shock wave guide members 28 are of elongate shape, advantageously in the form of a plurality of narrow strips of glass. The strips are arranged in three (by way of example) oblique layers 28.1, 28.2 and 28.3. In each layer, a plurality of strips is provided, one behind the other, in transverse orientation, and at small spacings. Between adjacent, rigid, strips, transverse bend lines are formed, allowing the sole to bend along said bend lines.

Upstream ends of the respective layers, are arranged generally across the width of the outer sole and are located proximate the sole. The layers converge toward their upper, laterally outer, ends, such that, at their downstream ends, the strips are closely proximate, even touching. The shock wave guide elements 28 are of glass, i.e. a material having a high acoustic speed, to promote progression of shock waves along the guide elements as opposed to transversely across the guide elements.

By way of development, advantageously, the portion of the sole volume 26 occupied by the shock wave guide elements 28 also contains a liquid, gel, viscous liquid, or the like having high latent heat of evaporation and a low boiling point. In this instance, the liquid is a mixture of water and alcohol (methanol) in a 70-30 mass proportion. Instead, the liquid may contain glycerin which has a relatively high acoustic speed.

The shock wave guide elements are thus surrounded by the liquid such that gas, e.g. air is displaced and is not present within that portion of the sole volume.

It is of particular importance that transfer of shock waves from the outer sole to the guide elements 28 takes place effectively. This is promoted by the proximity of the upstream ends of the elements to the sole, and by the presence of the liquid.

In an alternative embodiment, the strips of glass may be about parallel to one another, say at about 30° to the general plane of the outer sole. Thus, also their downstream ends will be spaced over a larger area. This has the advantage that spalling takes place over a larger area and that a more effective path of lesser resistance for the blast is created.

Further, optionally; the portion of the sole volume containing the shock wave guide elements 28 and liquid 30 is covered by an oblique shield or deflector 32 extending generally from an inner lower extremity of the composite sole 16 toward an upper outer corner of the composite sole 16. Preferably, the shield 32 is extended in integral manner into an anchor member 34 extending generally decumbently immediately underneath the inner sole 20. The shield 32 and anchor member 34 are conveniently in the form of bent plate material such as titanium, aluminum, aluminum alloy, or the like.

The shield 32 may, however, preferably, be in the form of carbon fibre or Kevlar fibre embedded in epoxy resin defining the shape of the shield. The V-shaped spacing between the shield and the anchor member is advantageously webbed at intervals to enhance mechanical strength and rigidity.

The Applicant, at this stage of development, is unsure about the effectiveness of such a shield. The Applicant expects that the shield may, advantageously, be substituted with a corresponding layer of glass. The Applicant fears that, in adverse conditions, the shield may become a missile potentially causing more harm than good.

In accordance with the invention, in a region of the sole volume 26 above the shield 32, and thus below the inner sole 20, there is provided a material having very low acoustic speed to provide a shock wave barrier. The Applicant has, surprisingly, found that the acoustic speed of vermiculite is or approaches zero and the use of vermiculite is, for this reason, favored. This material is indicated in the drawings by reference numeral 36 and is, preferably, in the form of coarse vermiculite chunks compressed and bonded together with a polyurethane bonding elastomer. The preformed compressed pieces are strengthened with internal binding material to give the shock wave barrier maximum physical strength without nullifying the very low shock wave transmission properties of the vermiculite. The binding material may be Kevlar cloth impregnated with an elastomer bonding material like isoprene.

Further in accordance with the invention, there is provided a space between upper and side surfaces of the foot 12 and the upper 14, which volume is filled by means of a fluid, preferably a liquid, or semi-liquid able to take up the shape of the foot 12 such that it can be brought into close contact with the skin and having a high acoustic speed, i.e. higher than the acoustic speed of flesh, e.g. glycerin or glycerin based mixtures. The liquid, e.g. glycerin, is contained in pads or sachets 40. The pads 40 may have outer skins of very thin and strong polyurethane. By way of development, the pads 40 may be filled with maximum amounts of fibre-glass roving, the glycerin then surrounding the fibre-glass roving and ensuring that all air is displaced.

Advantageously, the pads 40 are mounted on, or secured on a thin polyurethane sock donned by the wearer in the usual fashion.

It is important to appreciate that, although the area underneath the sole of the foot 12 is devoid of such pads, the pads surround the sides and top and also the back of the foot 12 and extends, surrounding the leg 13, to an elevation at least somewhat higher than the top of the boot.

It is of extreme importance that close contact be established between the skin of the foot and the inner surface of the pads. It is thus proposed that the pads have excess volume, and that the boot is tied relatively tightly around the foot and leg to compress the pads onto the surface of the foot and leg, the excess volume being displaced to above the upper extremity of the boot.

To sum up, the Applicant believes that a protective system comprising the protective boot 10 and the sock incorporating the pads 40 would function generally as follows:

Shock waves developed or generated by explosion or detonation of the mine are diverted or guided away by the shock wave guide elements and are further attenuated by the liquid surrounding the shock wave guide elements acting as heat absorption medium. They may be concentrated at a laterally outward extremity of the composite sole to cause spalling of the side 24. In other embodiments they may not be concentrated, such as to induce spalling over a larger area. The change of direction of the leader shock waves thus furthermore establishes a route away from the foot for the blast products following. The direction is chosen to be away from vulnerable parts of the victim's body. The force of the blast wave and its products then follow the established direction of lesser resistance. Possibly, the shield protects the foot from over-pressure and hard products. Any remaining or errant shock wave component that may find its way past the shield or past the guide elements if the shield is omitted, is checked or severely attenuated by means of the vermiculite barrier. Any remaining shock wave component penetrating the victim's foot and ankle is promoted to progress through the foot and into the pads of glycerin without losing undue amounts of energy while progressing through the foot and without spalling in the foot. The wide bottom of the boot distributes the energy absorption layers over the ground contact parts of the sole to prevent blow-past effects when a landmine explodes or detonates while not properly under the sole of the boot.

The Applicant believes that this invention incorporates a number of new, inventive and very effective ways of ameliorating the effects of a landmine explosion on the body of a human in an elegant and practical embodiment.

The invention claimed is:

1. A method of protecting a foot of a human from effects of a landmine explosion underneath said foot, including guiding shock waves caused by the landmine explosion obliquely away from said foot by means of a correspondingly obliquely oriented shock wave guide member embedded in a sole volume of an article of footwear worn by the human, the shock wave guide member being of a material having an acoustic speed of at least more than 3000 m/sec;

deflecting any stray component of the shock waves back into the guide member and attenuating propagation of any said stray component of the shock waves in a direction toward said foot in the sole volume of the article of footwear by means of a layer of material having a low acoustic speed arranged between the shock wave guide member and an inner sole of the article of footwear;

cracking the material of the shock wave guide member by means of said shock waves at a speed of crack progression lower than the acoustic speed of said material of the shock wave guide member, and spalling said material at a downstream end of the shock wave guide member to create a path of lesser resistance for a blast following the shock waves; and causing said blast following the shock waves to follow said path of lesser resistance and removing said cracked material to render said path open, in which the acoustic speed of said layer of material having a low acoustic speed is lower than 200 m/sec.

2. A method as claimed in claim 1 in which guiding the shock waves is obliquely laterally outwardly in accordance with an oblique outward orientation of the shock wave guide member.

3. A method as claimed in claim 1 in which the shock wave guide member is selected to have an acoustic speed higher than 3000 m/sec, preferably in the region of 6000 m/sec or more.

4. A method as claimed in claim 1 which includes absorbing heat energy by evaporating liquid contained in the sole volume.

5. A method as claimed in claim 4 in which the liquid is proximate the guide member.

6. A method as claimed in claim 1, in which said guiding of the shock waves, cracking of the shock wave material and creating a path of lesser resistance take place in composite fashion along a plurality of paths alongside one another by means of a composite shock wave guide member having a plurality of shock wave guide elements alongside one another.

7. A method as claimed in claim 6 in which each shock wave guide element is in the form of a strip of rigid glass containing material, the strips being oriented transversely to allow bending of the article of footwear along transverse bend lines intermediate adjacent strips, the strips being arranged in oblique layers having upstream ends which are located proximate the sole at transversely spaced positions, the layers extending upwardly outwardly towards their downstream ends positioned proximate an outer side of a sole of the article of footwear.

8. A method as claimed in claim 1 in which said layer of material having a low acoustic speed is in the form of vermiculite, or a composite material containing vermiculite.

9. A method of protecting a foot of a human from effects of a landmine explosion underneath said foot including guiding shock waves caused by the landmine explosion obliquely away from said foot by means of a correspondingly obliquely oriented shock wave guide member embedded in a sole volume of an article of footwear worn by the human, the shock wave guide member being of a material having an acoustic speed of more than 3000 m/sec;

deflecting any stray component of the shock wave into the guide member and attenuating propagation of any said stray component of the shock waves in a direction towards said foot in the sole volume of the article of footwear by means of a layer of material having a low acoustic speed arranged between the shock wave guide member and an inner sole of the article of footwear;

cracking the material of the shock wave guide member by means of said shock waves at a speed of crack progression lower than the acoustic speed of the shock wave guide member, and spalling said material at a downstream end of the shock wave guide member to create a path of lesser resistance for a blast following the shock waves; and causing said blast following the shock waves to follow said path of lesser resistance and removing said cracked material to render said path open, in which the acoustic speed of said layer of material having a lower acoustic speed is lower than 200 m/sec; and enhancing shock wave progression downstream of the foot by means of a layer of soak-out material in close contact with skin along a foot surface opposite a sole of the foot, the layer of material having an acoustic speed at least equal to acoustic speed of flesh.

10. A method as claimed in claim 9 in which the acoustic speed of said soak-out material is higher than the acoustic speed of water.

11. A method as claimed in claim 9 which includes containing the layer of soak-out material in association with a sock worn by the human.

12. An article of protective footwear for a human having a composite sole including an outer sole along one extremity of the article of footwear, a spaced inner sole for seating a foot of a user, and a sole volume intermediate the outer and the inner soles, the composite sole including in said sole volume a shock wave guide member oriented to guide shock waves caused by a landmine explosion obliquely away from said foot in use, the shock wave guide member being of a solid material which has an acoustic speed at least higher than 3000 m/sec; and a layer of blocking material having a low acoustic speed lower than 200 m/sec between the shock wave guide member and the inner sole, said solid material of the shock wave guide member, for example glass or a material containing glass or a ceramic material, is prone to being cracked and pulverized by shock waves at a speed of crack progression lower than its acoustic speed such that the pulverized material of the shock wave guide member is spalled at a downstream end of the shock wave guide member and displaced to create a path of lesser resistance for an ensuing blast.

13. An article of footwear as claimed in claim 12 in which the shock wave guide member extends from a laterally inner position proximate the outer sole obliquely upwardly to a laterally outward extremity of the composite sole.

14. An article of footwear as claimed in claim 12 in which the shock wave guide member has an acoustic speed higher than 3000 m/sec, preferably in the region of 6000 m/sec or more.

15. An article of footwear as claimed in claim 14 in which the shock wave guide member comprises a material selected from glass and a ceramic material.

16. An article of footwear as claimed in claim 12 in which the composite sole volume contains a liquid proximate the shock wave guide member.

17. An article of footwear as claimed in claim 12 in which the shock wave guide member is of composite structure comprising a plurality of shock wave guide elements extending alongside one another.

18. An article of footwear as claimed in claim 17 in which each shock wave guide element is in the form of a strip of rigid material selected from glass or glass containing material, or a ceramic material, the strips being oriented transversely and arranged adjacent one another to allow bending of the article of footwear along transverse bend lines intermediate adjacent strips, the strips being arranged in oblique layers having upstream ends which are located proximate the sole at transversely spaced positions, the layers extending upwardly outwardly towards their downstream ends positioned proximate an outer side of a sole of the article of footwear.

19. An article of footwear as claimed in claim 12 in which the blocking material is vermiculite, or a composite material containing vermiculite.

20. An article of protective footwear for a human having a composite sole including an outer sole along one extremity of the article of footwear, a spaced inner sole for seating a foot of a user, and a sole volume intermediate the outer and inner soles, the composite sole including in said sole volume;

a shock wave guide member oriented to guide shock waves caused by a landmine explosion obliquely away from said foot in use, the shock wave guide member being of a solid material which has an acoustic speed at least higher than 3000 m/sec;

a layer of blocking material having a low acoustic speed lower than 200 m/sec between the shock wave guide member and the inner sole, said solid material of the shock wave guide member, for example glass or a material containing glass or a ceramic material, is prone to being cracked and pulverized by shock waves at a speed of crack progression lower than its acoustic speed such that the pulverized material of the shock wave guide member is spalled at a downstream end of the shock wave guide member and displaced to create a path of lesser resistance for an ensuing blast; and a foot surrounding upper defining a foot cavity above the inner sole, and a layer of soak-out material in fluid form and having an acoustic speed equal to or higher than the acoustic speed of flesh and arranged to be in close contact with skin at a surface of the foot opposite a sole of the foot in use.

21. An article of footwear as claimed in claim 20 in which the soak-out material has an acoustic speed higher than that of water.

22. An article of footwear as claimed in claim 21 in which the soak-out material is or includes glycerin.

23. An article of footwear as claimed in claim 20 in which the soak-out material is contained in a closed, flexible container such as a pad or sachet.

24. An article of footwear as claimed in claim 20 in which the soak-out material is provided in amongst granular or filamentary material having an acoustic speed higher than the acoustic speed of the soak-out material.

25. The combination of an article of footwear as claimed in claim 20 and a sock, in which the soak-out material is contained in the sock.

26. A method of protecting a foot of a human from effects of a landmine explosion underneath said foot, including guiding shock waves caused by the landmine explosion obliquely away from said foot by means of a correspondingly obliquely oriented shock wave guide member embedded in a sole volume of an article of footwear worn by a human; and enhancing shock wave progression downstream of the foot by means of a layer of soak-out material in close contact with skin on a foot surface opposite a sole of the foot, the layer of material having an acoustic speed at least equal to acoustic speed of flesh.

27. An article of protective footwear for a human having a composite sole including an outer sole along one extremity of the article of footwear and a spaced inner sole for seating a foot of a user, and a sole volume intermediate the outer and inner soles, the composite sole including in said volume a shock wave guide member oriented to guide shock waves caused by a landmine explosion obliquely away from said foot in use; and a foot surrounding upper defining a foot cavity above the inner sole and a layer of soak-out material in fluid form and having an acoustic speed equal to or higher than the acoustic speed of flesh and arranged to be in close contact with the skin at a surface of the foot opposite a sole of the foot in use.

* * * * *